US010066896B2

(12) United States Patent
Zhu

(10) Patent No.: US 10,066,896 B2
(45) Date of Patent: Sep. 4, 2018

(54) AUTOMATIC PELLET LOADER OF PNEUMATIC AIR GUN

(71) Applicant: Zhongshan New Swan Technology Co., Ltd., Zhongshan (CN)

(72) Inventor: Zuopeng Zhu, Zhongshan (CN)

(73) Assignee: ZHONGSHAN NEW SWAN TECHNOLOGY CO., LTD., Zhongshan (CN)

( * ) Notice: Subject to any disclaimer, the term of this patent is extended or adjusted under 35 U.S.C. 154(b) by 0 days.

(21) Appl. No.: 15/801,300

(22) Filed: Nov. 1, 2017

(65) Prior Publication Data

US 2018/0073831 A1 Mar. 15, 2018

Related U.S. Application Data

(63) Continuation-in-part of application No. PCT/CN2016/077181, filed on Mar. 24, 2016.

(30) Foreign Application Priority Data

Jan. 15, 2016 (CN) ..... 2016 2 0040531 U

(51) Int. Cl.
*F41B 11/50* (2013.01)
*F41B 11/54* (2013.01)

(52) U.S. Cl.
CPC ..... *F41B 11/50* (2013.01); *F41B 11/54* (2013.01)

(58) Field of Classification Search
CPC ..... F41B 11/50; F41B 11/54; F41B 11/55
USPC ..... 124/45, 48, 49, 50, 51.1
See application file for complete search history.

(56) References Cited

U.S. PATENT DOCUMENTS 3,782,359 A * 1/1974 Kester ..... F41A 9/85 124/48
4,819,609 A * 4/1989 Tippmann ..... F41B 11/54 124/48
4,986,251 A * 1/1991 Lilley ..... F41B 11/54 124/48
5,150,701 A * 9/1992 Wackrow ..... F41B 11/54 124/48
5,205,270 A * 4/1993 Szente ..... F41B 11/55 124/49
6,470,871 B2 * 10/2002 Casas-Salva ..... F41B 11/54 124/48
6,688,298 B2 * 2/2004 Maeda ..... F41B 11/55 124/48

(Continued)

*Primary Examiner* — Alexander Niconovich
(74) *Attorney, Agent, or Firm* — Matthias Scholl, PC; Matthias Scholl

(57) ABSTRACT

An automatic pellet loader of a pneumatic air gun, including a pellet clip seat, a pellet clip lid, a pellet clip closure, and a magnetic shaft. The pellet clip seat and the pellet clip lid are connected to form a magazine case that includes a pellet inlet. The pellet clip closure is rotatably connected to the magazine case for opening or closing the pellet inlet. The bottom side wall of the pellet clip seat is provided with a loading sleeve that extends to the pellet clip lid. A center hole of the loading sleeve perpendicularly penetrates through the pellet clip seat. The pellet clip lid includes a loading channel allowing the pull-bolt thimble to pass through. The loading sleeve includes an opening close to an exit side of the loading channel through which a single pellet can slip autonomously into the loading channel.

4 Claims, 4 Drawing Sheets

(56) References Cited

U.S. PATENT DOCUMENTS

| | | | | |
|---|---|---|---|---|
| 6,796,300 | B2 * | 9/2004 | Petrosyan | F41B 11/55 124/48 |
| 7,963,280 | B2 * | 6/2011 | Maeda | F41B 11/54 124/45 |
| 8,387,606 | B1 * | 3/2013 | Yurechko | F41A 9/10 124/45 |
| 8,402,958 | B2 * | 3/2013 | Victor | F41A 9/73 124/45 |
| 8,931,467 | B2 * | 1/2015 | Lee | F41A 9/23 124/45 |
| 9,134,090 | B1 * | 9/2015 | Park | F41B 11/54 |
| 2012/0132187 | A1 * | 5/2012 | Murray | F41A 9/37 124/77 |

* cited by examiner

AUTOMATIC PELLET LOADER OF PNEUMATIC AIR GUN

CROSS-REFERENCE TO RELATED APPLICATIONS

This application is a continuation-in-part of International Patent Application No. PCT/CN2016/077181 with an international filing date of Mar. 24, 2016, designating the United States, and further claims foreign priority to Chinese Patent Application No. 201620040531.8 filed Jan. 15, 2016. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, and Cambridge, Mass. 02142.

BACKGROUND OF THE INVENTION

Field of the Invention

The present disclosure relates to an automatic pellet loader of a pneumatic air gun.

Description of the Related Art

Typically, the steel pellets of air guns are loaded to the barrel manually, leading to relatively low loading accuracy.

SUMMARY OF THE INVENTION

It is one objective of the present disclosure to provide an automatic pellet loader of a pneumatic air gun.

To achieve the above objective, in accordance with one embodiment of the present disclosure, there is provided an automatic pellet loader of a pneumatic air gun, comprising a pellet clip seat, a pellet clip lid, a pellet clip closure, and a magnetic shaft. The pellet clip seat and the pellet clip lid are connected to form a magazine case that comprises a pellet inlet. The pellet clip closure is rotatably connected to the magazine case for opening or closing the pellet inlet. A bottom side wall of the pellet clip seat is provided with a loading sleeve that extends to the pellet clip lid. A center hole of the loading sleeve perpendicularly penetrates through the pellet clip seat. The pellet clip lid comprises a loading channel allowing the pull-bolt thimble to pass through. The loading sleeve comprises an opening at the end thereof close to an exit side of the loading channel through which a single pellet can slip autonomously into the loading channel. The bottom of the loading channel comprises a shaft bore which is close to the opening and communicates with the loading channel. The magnetic shaft is tightly fitted in the shaft bore. The magnetic shaft is a magnet shaft that functions to magnetically attract a steel pellet that enters the loading channel through the opening to the top end thereof. An upper end of the magnetic shaft is flush with an upper edge of the shaft bore or hidden inside the shaft bore.

In a class of this embodiment, a fold edge is provided at an inner bottom wall of the pellet clip seat; a positioning slot is formed between the fold edge and an inner wall of the pellet clip seat; the pellet clip closure comprises a handle; when the pellet clip closure is rotated to close the pellet inlet, an edge of the pellet clip closure is inserted in the positioning slot.

In a class of this embodiment, an upper end of the valve body is provided with a groove for inserting the magazine case into the valve body; the magazine case is inserted in the groove; a bottom of the magazine case is provided with an inverted T shaped connector.

In a class of this embodiment, a lower end face of the connector is provided with a counterbore; a pillar is provided at a center of the counterbore; the pillar is hidden inside the counterbore; an O-shaped rubber ring is positioned in the counterbore and fitted on the pillar; and the O-shaped rubber ring protrudes from the lower end face of the connector.

Advantages of the automatic pellet loader of a pneumatic air gun according to embodiments of the invention are as follows.

1. The pellet clip seat and the pellet clip lid are connected to form a magazine case. A pellet inlet is formed at the upper end of the magazine case. The pellet clip closure is rotatably connected to the magazine case for opening or closing of the pellet inlet. Such a structural design enables a large number of pellets to be stored in a standalone magazine case, thereby making it easy to be carried. Meanwhile, a pellet clip closure with resistance is used to close the pellet inlet, so that the pellets cannot drop out easily.

2. The bottom side wall of the pellet clip seat is provided with a loading sleeve that extends to the pellet clip lid. A center hole of the loading sleeve perpendicularly penetrates through the pellet clip seat, and the pellet clip lid comprises a loading channel allowing the pull-bolt thimble to pass through. The loading sleeve comprises an opening at the end thereof close to the pellet inlet side through which a single pellet can slip autonomously into the loading channel. The bottom of the loading channel comprises a shaft bore which communicates with the loading channel. The shaft bore is close to the opening. The magnetic shaft is tightly fitted in the shaft bore. The magnetic shaft is a magnet shaft which can magnetically attract a steel pellet entering the loading channel through the opening to the top end thereof. An upper end of the magnetic shaft is flush with an upper edge of the shaft bore or hidden inside the shaft bore. With regard to introduction of a pellet, such a structural design enables a pellet to enter the loading channel autonomously under its own weight. Also, since only one pellet can be introduced at a time and is positioned through the magnetic shaft which is a highly magneto-optical shaft, the pellets can be introduced accurately.

3. The bottom of the magazine case is provided with an inverted T shaped connector that comprises a clamping edge protruding outward at both sides of its bottom. The bottom of the groove is provided with a connector slot capable of mating to the connector. Both side walls of the connector slot are provided with a concave bayonet. One of the side clamping edges of the connector can be inserted into one of the side bayonets at an angle. The other side clamping edge of the connector can be folded down to be clamped in the other bayonet to achieve clamping connection of the magazine. With a structural design in which the T shaped connector mates to the connector slot, the magazine can be mounted reliably.

4. The bottom end of the connector is provided with a positioning block protruding downward at one end thereof. The bottom of the connector slot is provided with a positioning counterbore capable of mating to the positioning block. The positioning block protrudes into the positioning counterbore when the magazine is fully clamped into the connector slot. The use of a protruding positioning block for positioning can prevent reversed installation and can allow reliable positioning.

5. The lower end face of the connector has a counterbore. A pillar is provided at the center of the counterbore and hidden inside the counterbore. An O-shaped rubber ring is positioned in the counterbore and tightly fitted on the pillar. The O-shaped rubber ring protrudes from the lower end face of the connector. With such an O-shaped rubber ring protruding from the lower end face of the connector, when the groove is engaged with the magazine, the O-shaped rubber ring maintains an opposite thrust to the clip to enable the groove to grip the magazine tightly, thereby achieving a secure connection between the groove and the magazine.

DETAILED DESCRIPTION OF THE EMBODIMENTS

Figure 1:
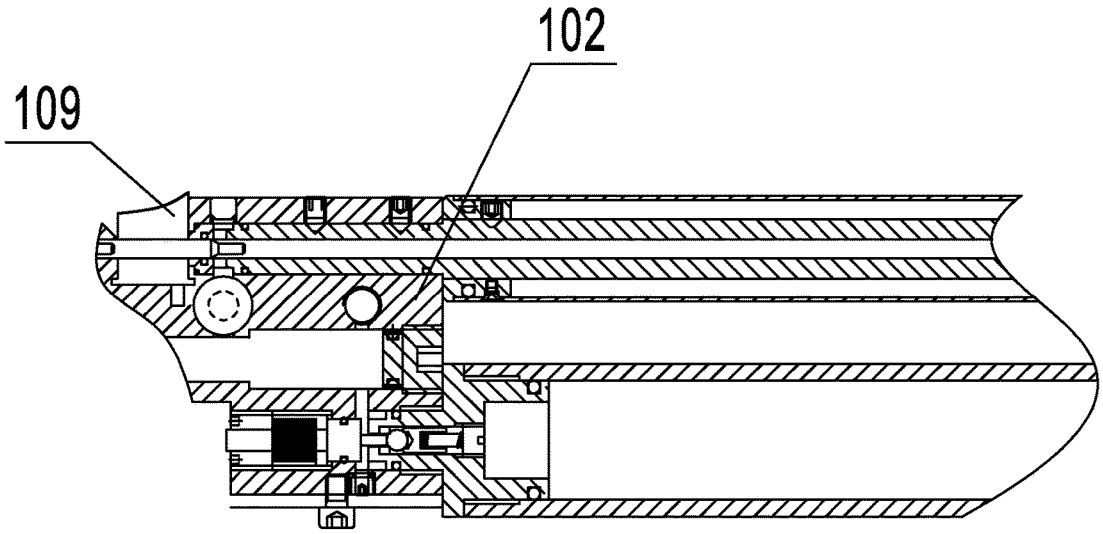
FIG. 1 is a schematic diagram of an automatic pellet loader which is installed on a pneumatic air gun in accordance with one embodiment of the present disclosure.
Figure 2:
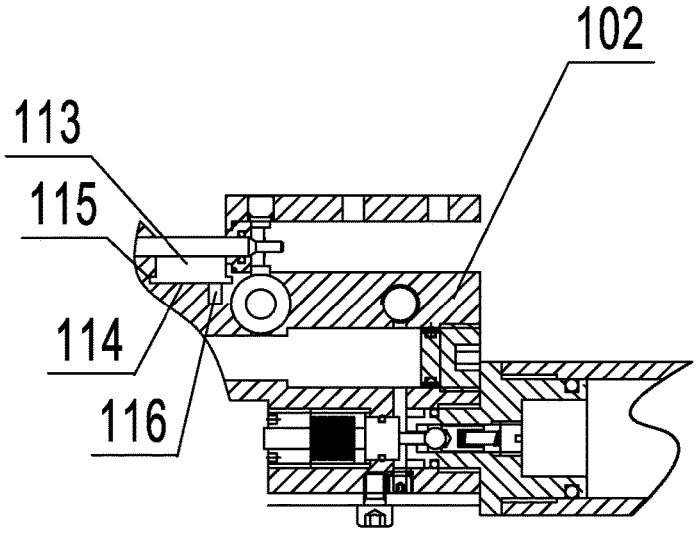
FIG. 2 is a cross-sectional view of a valve body in accordance with one embodiment of the present disclosure.
Figure 3:
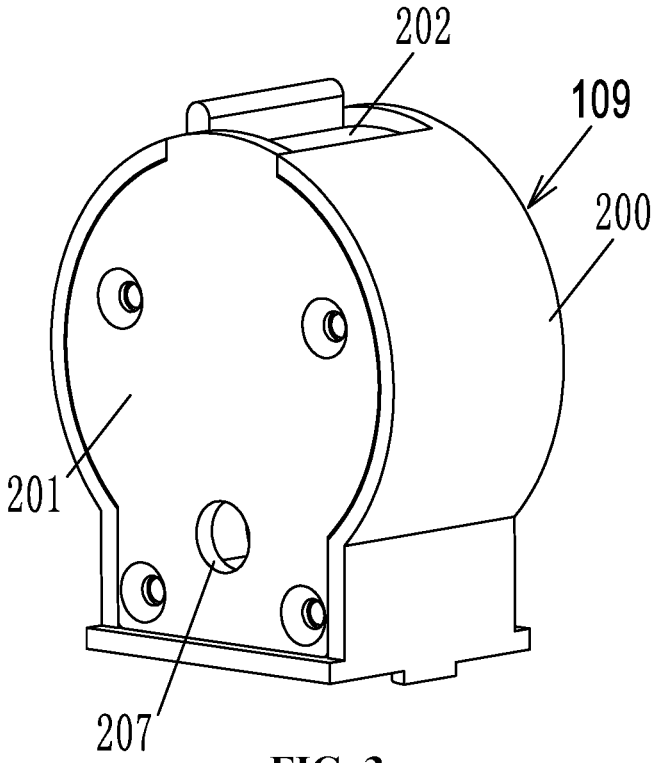
FIG. 3 is a first schematic diagram of a magazine case in accordance with one embodiment of the present disclosure.
Figure 4:
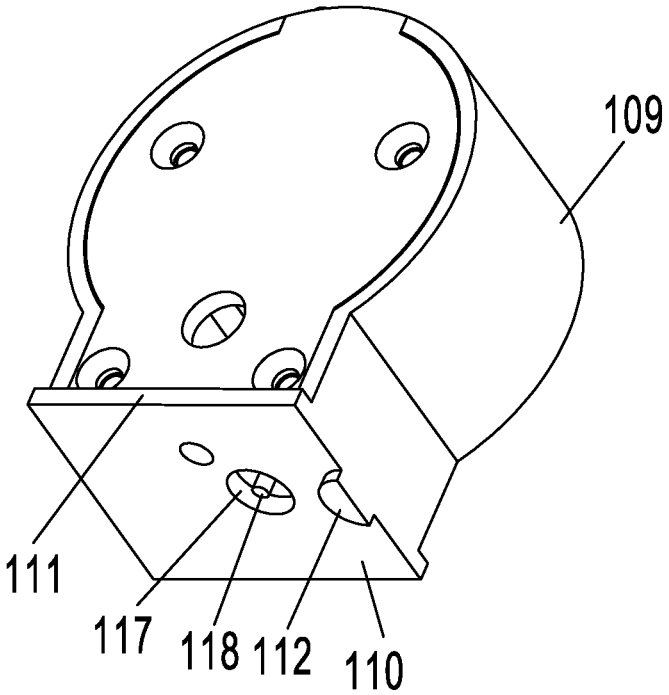
FIG. 4 is a second schematic diagram of a magazine case in accordance with one embodiment of the present disclosure.
Figure 5:
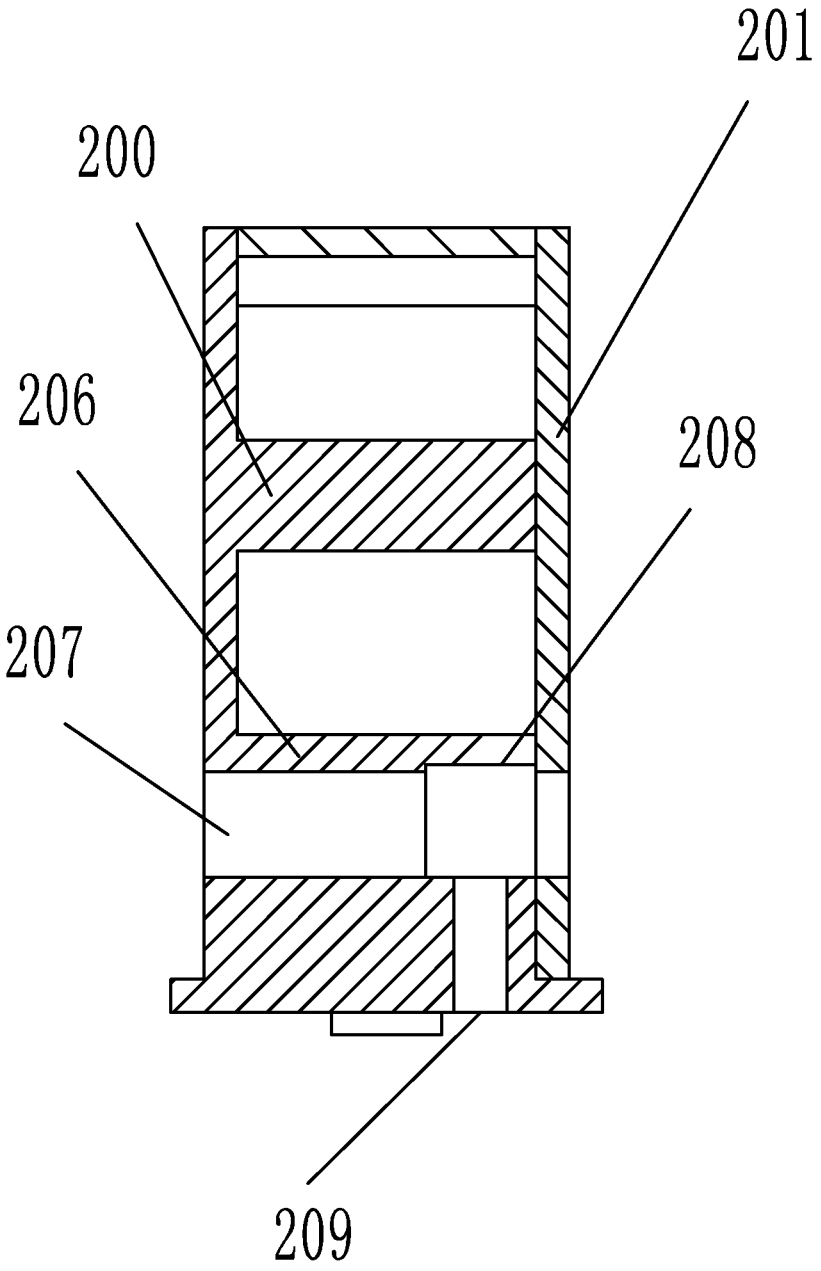
FIG. 5 is a cross-sectional view of a loading sleeve comprising an opening and a shaft bore in a magazine case in accordance with one embodiment of the present disclosure.
Figure 6:
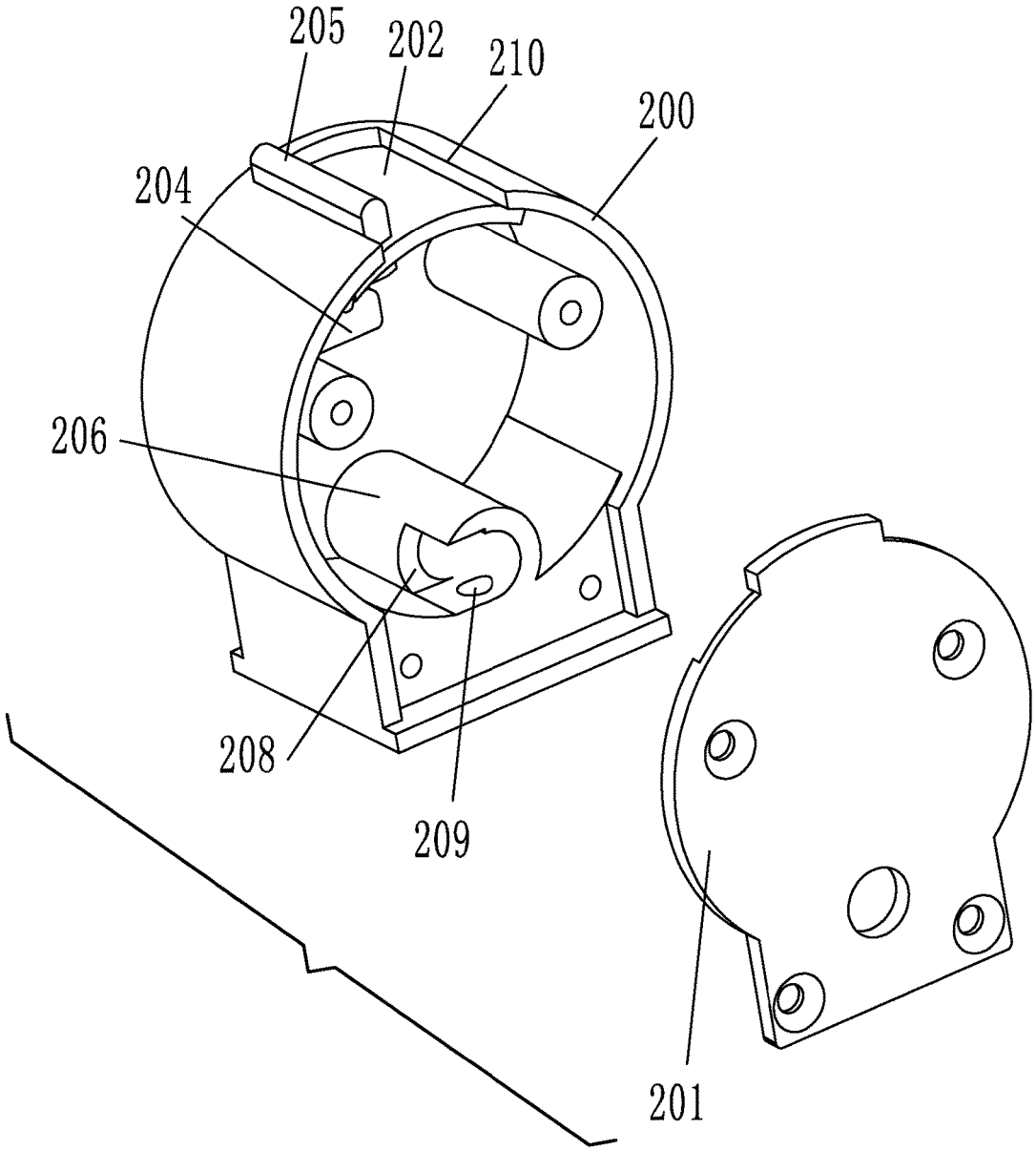
FIG. 6 is an exploded view of a magazine case in accordance with one embodiment of the present disclosure.

As shown in FIGS. 1, 2, 3, 4, 5, and 6, an automatic pellet loader of a pneumatic air gun which is detachably connected to a valve body 102 comprises a pellet clip seat 200, a pellet clip lid 201, a pellet clip closure 202, and a magnetic shaft (not shown). The pellet clip seat 200 and the pellet clip lid 201 are interlocked through a screw to form a magazine case 109 of a pellet loader. A pellet inlet 210 is formed at the upper end of the magazine case 109. The pellet clip closure 202 is rotatably connected to the magazine case for opening or closing of the pellet inlet 210. In this embodiment, a fold edge 204 is provided at the inner bottom wall of the pellet clip seat 200. A positioning slot is formed between the fold edge 204 and the inner wall of the pellet clip seat 200. The pellet clip closure 202 comprises a handle 205. When the pellet clip closure 202 is rotated to close the pellet inlet 210, the edge of the pellet clip closure 202 is inserted in the positioning slot.

The bottom side wall of the pellet clip seat 200 is provided with a loading sleeve 206 that extends to the pellet clip lid. The center hole of the loading sleeve 206 passes perpendicularly through the pellet clip seat 200. The pellet clip lid 201 comprises a loading channel 207 allowing the pull-bolt thimble to pass through. The end of the loading sleeve 206 close to the exit side of the loading channel 207 comprises an opening 208 through which a single pellet can slip autonomously into the loading channel. The bottom of the loading channel 207 comprises a shaft bore 209 which is close to the opening 208 and communicates with the loading channel 207. The magnetic shaft is fitted tightly inside the shaft bore 209. The magnetic shaft is a magnet shaft which can magnetically attract a steel pellet entering the loading channel 207 through the opening 208 to the top end thereof. An upper end of the magnetic shaft is flush with an upper edge of the shaft bore 209 or hidden inside the shaft bore 209.

In this embodiment, the magazine case 109 is inserted in a groove 113 of the valve body 102. The bottom of the magazine case 109 is provided with an inverted T shaped connector 110. The connector 110 comprises a clamping edge 111 protruding outward on both sides of its bottom and a positioning block 112 protruding downward at one side of its bottom end. The bottom of the groove 113 is provided with a connector slot 114 that functions to mate to the connector 110, and the bottom of the connector slot 114 is provided with a positioning counterbore 116 that functions to mate to the positioning block 112. Both side walls of the connector slot 114 are provided with a concave bayonet 115. One of the side clamping edges 111 of the connector 110 can be inserted into one of the side bayonets 115 at an angle. The other side clamping edge 111 of the connector 110 can be folded down to be clamped into the other bayonet 115 to achieve clamping connection of the magazine. The positioning block 112 protrudes into the positioning counterbore 116 when the connector 110 is fully clamped in the connector slot 114.

In this embodiment, the groove 113 has an internal space that matches the shape of the magazine. For ease of inclined clamping of the magazine, the groove 113 has an inclined side wall, so that the magazine inserted in the groove 113 can be inclined toward the inclined side wall and clamped in the slot 114 at the bottom of the groove 113.

In this embodiment, the lower end face of the connector 110 has a counterbore 117. A pillar 118 is provided at the center of the counterbore 117 and hidden inside the counterbore 117. An O-shaped rubber ring is positioned in the counterbore 117 and tightly fitted on the pillar 118, with its outer side protruding from the lower end face of the connector 110. When the magazine is clamped in the groove 113, the O-shaped rubber ring maintains an opposing thrust to the magazine to enable a tight engagement between the slot and the magazine, thereby achieving a secure connection between the groove 113 and the magazine.

Unless otherwise indicated, the numerical ranges involved in the invention include the end values. While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A pellet loader, comprising:

a pellet clip seat;

a pellet clip lid;

a pellet clip closure; and a magnetic shaft;

wherein the pellet clip seat and the pellet clip lid are connected to form a magazine case comprising a pellet inlet;

the pellet clip closure is rotatably connected to the magazine case for opening or closing the pellet inlet;

a bottom side wall of the pellet clip seat is provided with a loading sleeve that extends to the pellet clip lid;

the loading sleeve is a hollow cylinder having a center hole;

the center hole perpendicularly penetrates through the pellet clip seat and the pellet clip lid to form a loading channel adapted to allow a pull-bolt thimble to pass through;

one end of the loading sleeve close to an exit side of the loading channel comprises an opening through which a single pellet can slip autonomously into the loading channel;

a bottom of the loading channel comprises a shaft bore which is close to the opening and communicates with the loading channel;

the magnetic shaft is fitted in the shaft bore;

an upper end of the magnetic shaft is flush with an upper edge of the shaft bore or hidden inside the shaft bore; and when in use, the magnetic shaft magnetically attracts a steel pellet that enters the loading channel via the opening to a top end thereof.

2. The loader of claim 1, wherein a fold edge is provided at an inner bottom wall of the pellet clip seat; a positioning slot is formed between the fold edge and an inner wall of the pellet clip seat; the pellet clip closure comprises a handle; when the pellet clip closure is rotated to close the pellet inlet, an edge of the pellet clip closure is inserted in the positioning slot.

3. The loader of claim 1, wherein a bottom of the magazine case is provided with an inverted T-shaped connector; the inverted T-shaped connector is adapted to be inserted into a groove of a valve body on an air gun.

4. The loader of claim 3, wherein a lower end face of the inverted T-shaped connector is provided with a counterbore; a pillar is provided at a center of the counterbore; the pillar is hidden inside the counterbore; an O-shaped rubber ring is positioned in the counterbore and fitted on the pillar; and the O-shaped rubber ring protrudes from the lower end face of the inverted T-shaped connector.

* * * * *